US006918417B2

(12) United States Patent
Bernhard

(10) Patent No.: US 6,918,417 B2
(45) Date of Patent: Jul. 19, 2005

(54) BEVERAGE BOTTLING PLANT FOR FILLING BOTTLES WITH A LIQUID BEVERAGE FILLING MATERIAL, AND AN EASILY CLEANED LIFTING DEVICE IN A BEVERAGE BOTTLING PLANT

(75) Inventor: Herbert Bernhard, Wolfsheim (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 10/813,651

(22) Filed: Mar. 30, 2004

(65) Prior Publication Data

US 2005/0034779 A1 Feb. 17, 2005

(30) Foreign Application Priority Data

Apr. 1, 2003 (DE) ..... P 103 14 634

(51) Int. Cl.[7] ..... B65B 1/04

(52) U.S. Cl. ..... 141/89; 141/148; 141/172; 141/85

(58) Field of Search ..... 141/85, 89–91, 141/129, 144, 148–150, 172; 134/166 C

(56) References Cited

U.S. PATENT DOCUMENTS 2,634,894 A * 4/1953 Fischer et al. ..... 141/91
3,516,455 A * 6/1970 Carter ..... 141/90
6,142,169 A * 11/2000 Lees et al. ..... 137/240

* cited by examiner

*Primary Examiner*—Steven O. Douglas
(74) *Attorney, Agent, or Firm*—Nils H. Ljungman & Associates

(57) ABSTRACT

A beverage bottling plant for filling bottles with a liquid beverage filling material, and an easily cleaned lifting device in a beverage bottling plant. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 5 Drawing Sheets

BEVERAGE BOTTLING PLANT FOR FILLING BOTTLES WITH A LIQUID BEVERAGE FILLING MATERIAL, AND AN EASILY CLEANED LIFTING DEVICE IN A BEVERAGE BOTTLING PLANT

BACKGROUND

1. Technical Field

The application relates to a beverage bottling plant for filling bottles with a liquid beverage filling material, and an easily cleaned lifting device in a beverage bottling plant.

2. Background Information

Beverage bottling plants for filling bottles with liquid beverage filling material have a filling machine for filling bottles with a liquid in a container filling process. Such filling machines usually comprise a plurality of filling positions, with each filling position having a filling element to fill a corresponding bottle with liquid beverage filling material. There is possibly also provided an apparatus to move empty bottles to a filling element, and each filling element being configured and disposed to receive a corresponding bottles to be filled from said apparatus to move empty bottles. Upon filling, an apparatus removes a filled bottle from a filling element. There may possibly also be provided an apparatus to hold a bottle to be filled in sealing attitude at a filling element, and each filling element having a portion to introduce at least one process pressure into the interior space of a corresponding bottle, as well as at least one pressure sensor for each filling element, each sensor being disposed and configured to sense a pressure related to the interior of a corresponding bottle that is connected with the corresponding filling element, and each sensor being configured to produce at least one indication representative of a sensed pressure related to the interior of a corresponding bottle. There may also be provided a controller that is configured to receive from a corresponding sensor at least one indication representative of a sensed pressure related to the interior of a bottle; and apparatus configured to control at least one process parameter related to filling a bottle in the filling machine. That controller may be further configured to control the control apparatus for the at least one process parameter of the filling machine.

Also known are filling plant systems that include a cleaning station to rinse or otherwise clean containers such as bottles and the like. Thus, a beverage bottling plant for filling bottles with a liquid beverage filling material can possibly comprise a cleaning station to clean bottles, a beverage filling machine with a plurality of beverage filling positions, each beverage filling position having a beverage filling device for filling bottles with liquid beverage filling material. The filling devices may have an apparatus being configured to introduce a predetermined volume of liquid beverage filling material into the interior of bottles to a substantially predetermined level of liquid beverage filling material, and the apparatus configured to introduce a predetermined flow of liquid beverage filling material comprising apparatus being configured to terminate the filling of beverage bottles upon liquid beverage filling material reaching said substantially predetermined level in bottles. There may also be provided a conveyer arrangement being configured and disposed to move bottles, for example, from an inspecting machine to the filling machine.

Upon filling, a closing station closes filled bottles.

There may further be provided a conveyer arrangement configured to transfer filled bottles from the filling machine to the closing station, a labeling station in the event that labeling of the filled bottles is intended, as well as a loading station that is configured to load filled bottles into containers, for example, in a six-pack arrangement. There may also be provided a conveyor arrangement configured to transfer filled bottles from the closing station to the loading station, and to and from the labeling station.

There is increasing demand in the beverage industry to fill containers with a beverage that does not need to be subjected to heating, due to reasons of taste or due to other reasons. In the case of cold-aseptic filling it is of particular importance to carry out the entire processing, from cleaning of the containers to the actual filling stage and to the closing of the containers, in a manner that is devoid of germs.

This aim requires, as a rule, special configuration of the entire equipment. In this it is of particular importance to design the equipment in such a way that the presence of recesses, edges, or undercuts is minimized, because these structures favor the collection of dirt and/or damaging microorganisms and, furthermore, also impair cleaning of the machines.

Additionally, it is of substantial advantage, to provide devices that permit cleaning of the equipment in a simple manner. Thus, practical application particularly desires so-called CIP-installations (cleaning in process), because such installations permit low-cost cleaning, with the entire installation being automatically rinsed with a disinfecting medium.

While previously CIP-installations and also the respective configuration of many machines or, respectively, machine components, have been the subject of many publications, the corresponding configuration of lifting devices at the filling machines has hitherto been neglected.

Container filling machines are preferably of a design of rotating machines that have a plurality of filling elements at their rotors. Support plates or support tables that can be raised and lowered are associated with the filling elements, whereby the support tables receive the containers that are to be filled via input star wheels. Further, a so-called lifting device is associated with each of these support tables; with these lifting devices having the purpose of raising the containers that are disposed on the support tables towards the filling elements and to press the containers against the filling elements. There have also become known solutions in which the support tables are replaced by radially projecting gripper elements that grasp the containers at the neck portion and hold the containers, these containers being in such cases as a rule plastic bottles.

In order to accomplish the above-described function, these lifting devices generally comprise a combination of a fixed piston and a moveably disposed cylinder structure that surrounds this piston. The structural components are disposed vertically, and with the piston being rigidly connected to the rotor of the container filling machine. The cylinder can be moved up and down in vertical movements. The cylinder chamber or cavity that is established between the fixed piston and the moveable cylinder, is, in most cases, impacted by compressed air, the compressed air being passed through a bore or passage within the piston, such that the cylinder is urged to move in vertical direction to an upper position. This movement is limited by a roller that is secured to the cylinder, which roller is configured to rotate about its longitudinal axis, and with the roller contacting a curved path of a stationary cam structure. By way of the rotating movement of the rotor of the container filling machine, the roller rolls upon the curved path of the cam structure, that is, it follows the course of the curved path of the cam structure and simultaneously carries out an upwardly directed movement and a downwardly directed movement, which movements, due to the configuration of the design of the machine, are also carried out by the support table and, accordingly, a container supported on a support table.

Lifting devices have been proposed, for example, in German Patent No. DE 39 19 565. In its designed structure it follows the above-described features, but with means for cleaning of the lifting device not being present, this prior art embodiment providing a considerable disadvantage. German Patent No. 39 19 565 and its corresponding European Patent Application Publication 0 402 643 published on Dec. 19, 1990 and naming Andreas Finger et al. as inventors, are hereby incorporated by reference as if set forth in their entirety herein.

Lifting devices that comprise means to clean the lifting devices have hitherto not become known.

A further drawback with lifting devices arises in practical operation thereby that the seals that are disposed between the piston rod and the inner wall of the cylinder are subjected to high wear. Particularly contributing to wear is the fact that the seal is moved at a high frequency over a lengthy path over a smooth, but dry, metal surface.

OBJECTS

One object of an embodiment is believed at the time of the filing of this patent application to possibly reside broadly in a lifting device that comprises means which permit automatic cleaning in a simple manner, and in this becomes useful in a special way in cold-aseptic filling installations.

Another object of an embodiment is believed at the time of the filing of this patent application to possibly reside broadly in an arrangement that is configured to minimize the wear of seal elements disposed between the piston rod and the inner wall of the associated cylinder.

SUMMARY

One feature or aspect of an embodiment is believed at the time of the filing of this patent application to possibly reside broadly in a beverage bottling plant for filling bottles with a liquid beverage filling material, said beverage bottling plant comprising: a filling machine being configured to fill empty bottles with liquid beverage filling material; a conveyer arrangement being configured and disposed to move empty bottles to said filling machine; said filling machine comprising a rotor having a peripheral portion; said filling machine defining a vertical axis about which said rotor is configured to rotate; said beverage filling machine comprising a plurality of beverage filling positions disposed about said peripheral portion of said rotor; each beverage filling position comprising a beverage filling device for filling bottles with liquid beverage filling material; each filling device comprising apparatus being configured to introduce a predetermined volume of liquid beverage filling material into the interior of bottles to a substantially predetermined level of liquid beverage filling material; said apparatus being configured to introduce a predetermined volume of liquid beverage filling material comprising apparatus being configured to terminate the filling of beverage bottles upon liquid beverage filling material reaching said substantially predetermined level in bottles; each filling position comprising a support configured and disposed to maintain a bottle in a predetermined position for filling a by a corresponding filling device; each filling position comprising an arrangement to seal a bottle for filling a bottle with an effervescent beverage; apparatus being configured to raise and to lower said bottle support and a bottle supported thereby; said lifting apparatus being configured to raise and lower said bottle support comprising: a rod having an exterior, a first, lower, end and a second, upper, end remote from said lower end; said lower end of said rod being secured to said rotor of said filling machine; a cylinder having a longitudinal axis and having an outer wall and an inner wall disposed about the longitudinal cylinder axis and forming a cylinder interior; said inner cylinder wall being configured and disposed to slide about said rod to permit up-and-down movement of said cylinder about said rod; said cylinder having a first, upper, end and a second, lower, end remote from said upper end of said cylinder; said bottle support being secured to said upper end of said cylinder to permit raising and lowering of said bottle support and a bottle supported thereby; a collar secured to said lower end of said cylinder; a first, upper, stop structure secured to said rotor of said filling machine adjacent said upper end of said rod; said cylinder outer wall being configured to slide within said upper stop structure; a second, lower, stop structure operatively connected to said upper stop structure and being configured and disposed to slide on said outer cylinder wall; a spring disposed between said upper stop structure and said lower stop structure and being configured to be compressed between said upper stop structure and said lower stop structure; said rod comprising at least one first longitudinal passage configured to permit passage of a pressure medium from said lower end of said rod into said cylinder; said cylinder being configured to be raised by a first, lower, pressure of a pressure medium passing through said first longitudinal passage of said rod and thus raising said bottle support and a bottle supported thereby to a first, lower, position being a position in which a bottle is disposed remote from said seal arrangement which lower position is configured for filling of a bottle with a still beverage; said cylinder being configured to be raised by a second pressure, being a pressure higher than the first pressure, of a pressure medium passing through said first longitudinal passage of said rod and thus raising said bottle support and a bottle supported thereby to a second, higher, position being a position in which a bottle is sealed to said sealing arrangement which higher position is configured for filling of a bottle with an effervescent beverage; said collar being configured to be disposed against said lower stop structure to maintain said bottle support and a bottle supported thereby in the lower position upon the lower pressure being applied in said cylinder; said spring being configured and disposed to be compressed between said upper stop structure and said lower stop structure by said collar upon the higher pressure being applied in said cylinder to permit raising of said bottle support and a bottle supported thereby to the higher position; and a seal arrangement disposed about said rod and being configured to sealingly engage said inner wall of said cylinder; said rod comprising at least one second longitudinal passage disposed adjacent said first longitudinal passage and being configured to permit passage of at least one of: a cleaning medium to clean said rod and said inner cylinder wall; and a cooling medium to cool said cylinder and said rod; and a lubricating medium to lubricate said rod and said inner cylinder wall; said first longitudinal passage comprising an inlet; said second longitudinal passage comprising an inlet; a fitting being configured and disposed to connect said inlet of said first longitudinal passage to a source of pressure medium and also to connect said inlet of said second longitudinal passage to a source of at least one of: a cleaning medium; and a cooling medium; and a lubricating medium; at least one passage configured to connect said second longitudinal passage to said exterior of said rod and to said interior of said cylinder for the supply of at least one of: a cleaning medium; and a cooling medium; and a lubricating medium; into said cylinder; said filling machine further comprising: a first valving arrangement being configured and disposed to introduce a pressure medium through said fitting, and through said first longitudinal passage, and into said cylinder; a second valving arrangement being configured and disposed to introduce at least one of: a cleaning medium; and a cooling medium; and a lubricating medium; through said fitting, and through said second longitudinal passage and said connecting passage, and into said cylinder; and a control arrangement being configured and disposed to control introduction of a pressure medium into said cylinder during operating cycles of said filling machine and to control introduction of at least one of: a cleaning medium; and a cooling medium; and a lubricating medium; into said cylinder during servicing cycles of said filling machine.

Another feature or aspect of an embodiment is believed at the time of the filing of this patent application to possibly reside broadly in a method for operating an arrangement for operating and servicing a lifting device of a container filling machine in a plant for filling containers with a liquid beverage, said arrangement comprising: a first valving arrangement being configured and disposed to introduce a pressure medium into said lifting device and to release a pressure medium from said lifting device to raise and lower said lifting device in said filling machine for filling of containers; a second valving arrangement being configured and disposed to introduce at least one of: a cleaning medium; and a lubricating medium; into said lifting device; and a control arrangement being configured and disposed to control introduction of a pressure medium into said lifting device during filling of containers, and to control introduction of at least one of: a cleaning medium; and a lubricating medium; into said lifting device; said method comprising the steps of: controlling opening of said first valving arrangement to introduce a pressure medium into said lifting device and to release a pressure medium from said lifting device to raise and lower said lifting device in said filling machine during filling of containers; introducing a pressure medium into said lifting device to raise said lifting device during filling of containers; releasing a pressure medium from said lifting device to lower said lifting device during filling of containers; controlling opening of said second valving arrangement to introduce at least one of: a cleaning medium; and a lubricating medium; into said lifting device; and also controlling at least one of (a) and (b), wherein (a) and (b) comprise: (a) introducing a cleaning medium into said lifting device to clean said lifting device; and (b) introducing a lubricating medium into said lifting device to lubricate said lifting device.

Yet another feature or aspect of an embodiment is believed at the time of the filing of this patent application to possibly reside broadly in an arrangement for operating and servicing a lifting device of a container filling machine in a plant for filling containers with a liquid beverage, said arrangement comprising: a first valving arrangement being configured and disposed to introduce a pressure medium into said lifting device and to release a pressure medium from said lifting device to raise and lower said lifting device in said filling machine for filling of containers; a second valving arrangement being configured and disposed to introduce at least one of: a cleaning medium; and a lubricating medium; into said lifting device; and a control arrangement being configured and disposed to control introduction of a pressure medium into said lifting device during filling of containers, and to control introduction of at least one of: a cleaning medium; and a lubricating medium; into said lifting device.

A further feature or aspect of an embodiment is believed at the time of the filing of this patent application to possibly reside broadly in that there is provision made to furnish the piston of the lifting device with special channels which are configured to spray the inner wall of the cylinder and the piston rod with a disinfectant or disinfecting medium during a disinfecting phase, and by means of which channels the inner wall of the cylinder, during regular filling operation, can continuously be sprayed with a wear-reducing and/or cooling liquid, such as, for example, water.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The application is explained in greater detail below with reference to the accompanying drawings.

DESCRIPTION OF EMBODIMENTS

Figure 1:
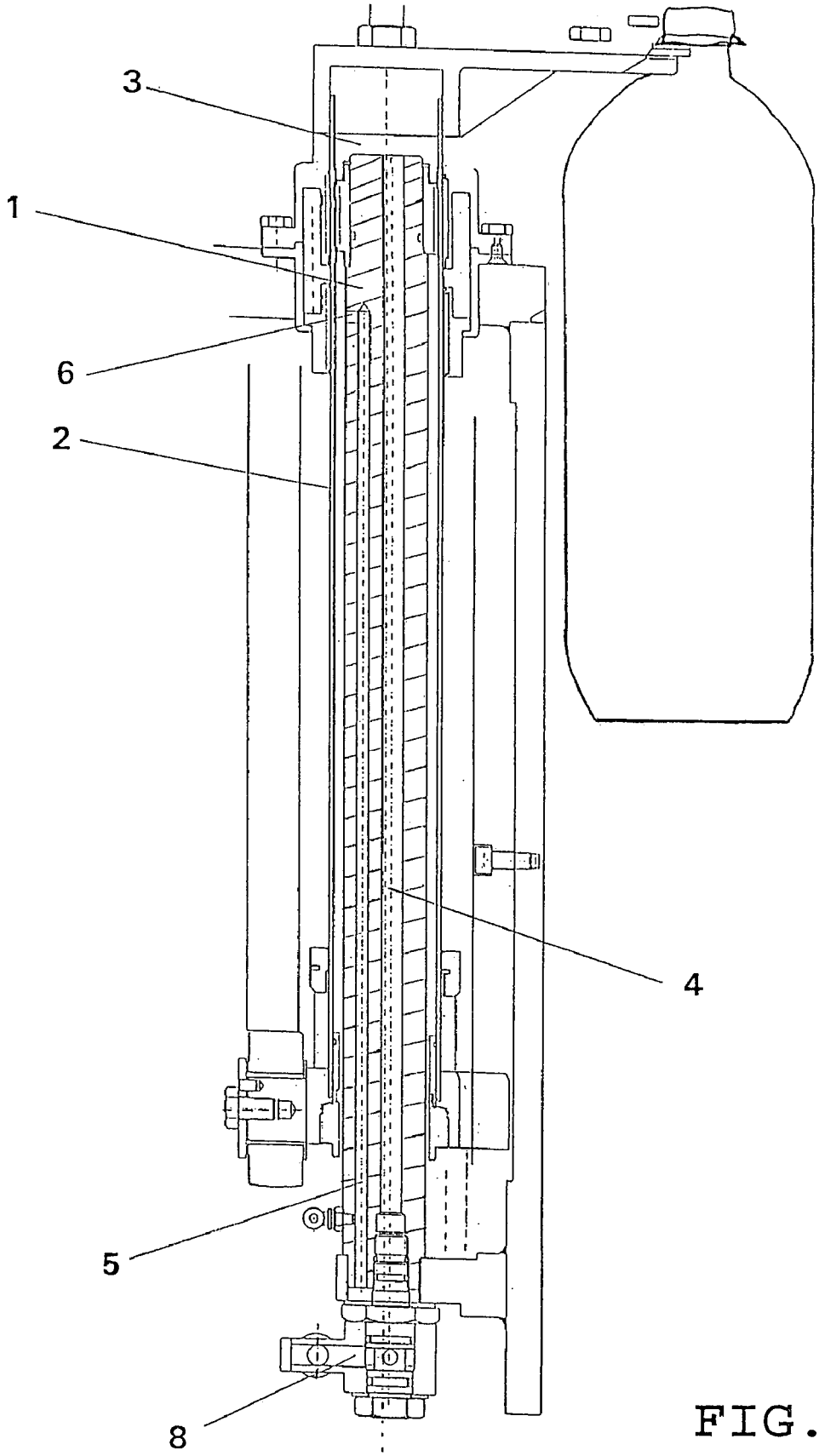
FIG. 1 is an elevational, cross-sectional view of a lifting device in accordance with one embodiment of the application.

Further development details, advantages and possibilities of application of this present application can be obtained from the following description of embodiments and the drawing. With this, all described and/or illustrated features per se or in any combination, comprise the substance of this present application, regardless of their combination in the claims or their dependency. At the same time, the content of the claims is made a component of the description.

Figure 1A:
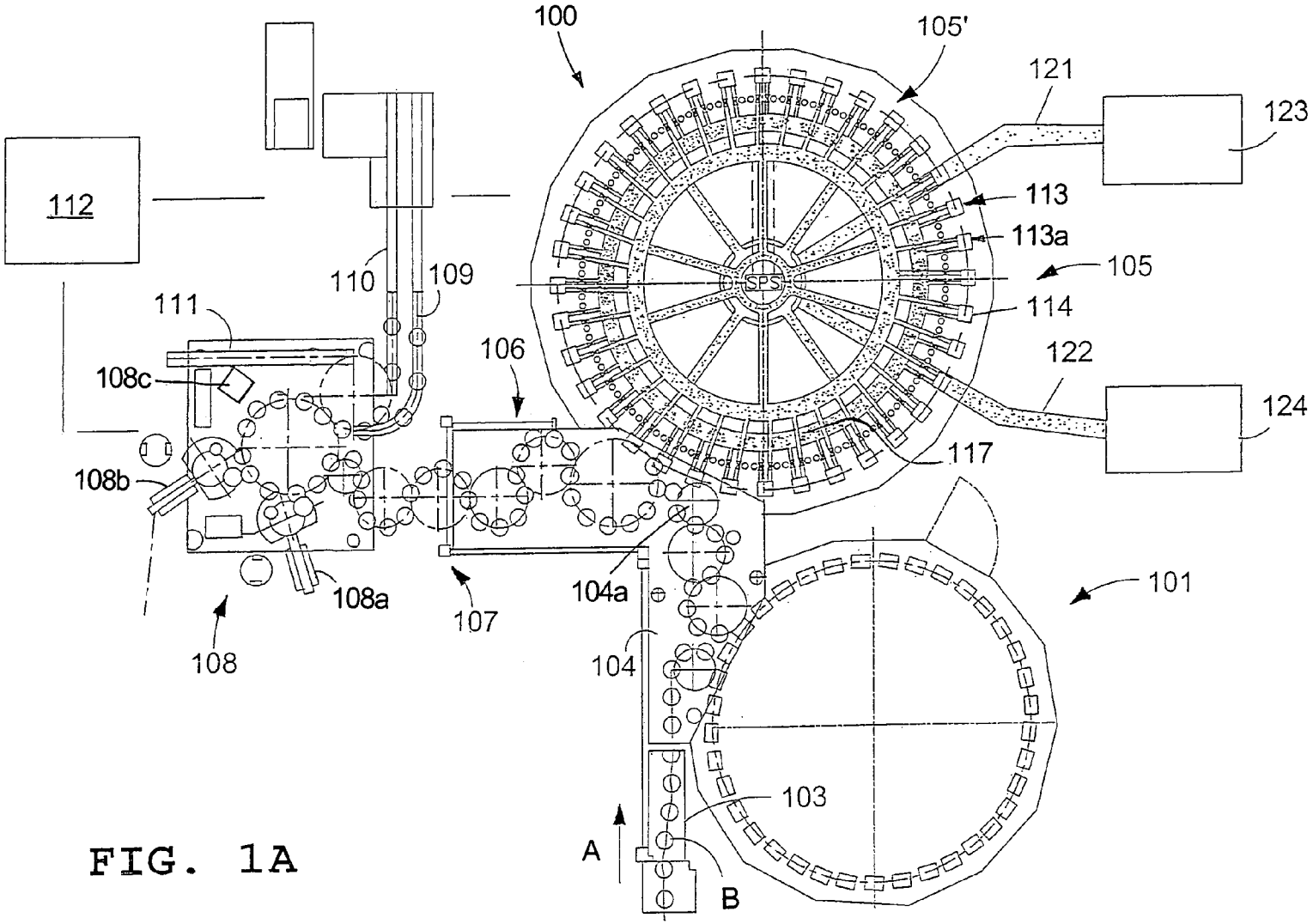
FIG. 1A is a schematic illustration of a container filling plant in accordance with one embodiment of the present application.

FIG. 1A shows schematically the main components of one possible embodiment example of a system for filling containers, specifically, an embodiment of a beverage bottling plant 100 for filling bottles B with liquid beverage filling material, in accordance with one embodiment, or in which system or plant could possibly be utilized at least one aspect, or several aspects, of the embodiments disclosed herein.

FIG. 1A shows a rinser or rinser station 101, to which the containers, namely bottles B, are fed in the direction of travel as is indicated by the arrow A, by means of a conveyer line or conveyer arrangement 103, and downstream of rinser station 101, in the direction of travel as is indicated by the arrow A, the rinsed bottles B are transported to a beverage filling machine 105 by means of a conveyer line or conveyer arrangement 104 that is formed, for example, by a star wheel conveyer or a plurality of star wheels of a conveyer arrangement. The conveyer arrangement 104 may possibly have a star wheel 104*a* that introduces bottles B to the filling machine 105.

Downstream of the filling machine 105, in the direction of travel of the bottles B, there can preferably be a closer or closer station 106 which closes the bottles B.

The closer or closer station 106 can, for example, be connected directly to a labeling device or labeling station 108, such as, for example, by means of a conveyer line or conveyer arrangement 107 that may be formed, for example, by a plurality of star wheels of a conveyer arrangement.

In the illustrated embodiment, the labeling device or labeling machine or labeling station 108 has, for example, three outputs, namely one output formed by a conveyer or conveyer arrangement 109 for bottles B that are filled with a first product. The first product may possibly be provided by a product mixer 123 that is connected to the filling machine 105, for example, through a conduit 121, and bottles B that are filled with a predetermined volume of liquid beverage filling material, that is, the first product, are then labeled by a labeling module 108*a* in the labeling stations 108 corresponding to this first product delivered from product mixer 123 to the beverage filling machine 105 and thence to the corresponding bottles B.

A second output that is formed by a conveyer or conveyer arrangement 110 is provided for those bottles B that are filled with a second product. The second product may emanate from a second product mixer 124 that is connected, for example, through a conduit 122 to the filling machine 105, and these bottles B filled with a predetermined volume of liquid beverage filling material comprising the second product are then correspondingly labeled by a labeling module 108*b* in the labeling station 108 corresponding to this second product.

A third output, for example, formed by a conveyer or conveyer arrangement 111, removes any bottles B which have been incorrectly labeled as may have been determined by an inspecting device or an inspecting station, or an inspecting module 108*c* that may possibly form a part of the labeling station 108.

In FIG. 1A item 112 is a central control unit or, expressed differently, a controller or a system or arrangement which includes a process controller that, among other things, controls the operation of the above-referenced system or plant.

The beverage filling machine 105 is preferably of the revolving design, with a rotor 105', which revolves around a vertical machine axis. On the periphery of the rotor 105' there are a number of filling positions 113, each of which comprises a lifting device 113*a* that is configured and disposed to present bottles B for filling, as well as a filling device or element or apparatus 114 located or configured to be located above the corresponding lifting device 113*a* and the corresponding bottle B presented by the lifting device 113*a*. The details of a lifting device 113*a* are discussed in the following. The filling device or apparatus 114 comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, filling elements 114 are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of an external connecting line 121 to the external reservoir or product mixer 123 to supply the product, that is, product mix one, for example.

As well as the more typical filling machines having one toroidal vessel, it is possible that in at least one possible embodiment a filling machine could possibly be utilized wherein each filling device 114 is preferably connected by means of two connections to a toroidal vessel 117 which contains a first product, say by means of a first connection, for example, 121, and to a second toroidal vessel which contains a second product, say by means of the second connection, for example, 122. In this case, each filling device 114 can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

FIG. 1 shows in a simplified cross-sectional illustration a lifting device in accordance with the application, that is shown in the retracted, non-activated state.

As illustrated in FIG. 1, the piston rod 1 of the lifting device is firstly provided with a first bore or passage 4 through which, during normal filling operation, the required compressed air is passed into the chamber 3 that results between the cylinder 2 and the piston rod 1, this chamber comprising the displacement space or piston-swept space. Additionally, the piston rod 1 is provided with at least one second bore or passage 5 through which the disinfecting medium is passed during the disinfecting phase of the machine. This bore or passage 5 terminates beneath the seal 7 that seals the piston rod 1 and cylinder 2 with respect to one another.

During the normal filling operation, the liquid that is employed as friction-reducing medium and/or cooling medium, is passed through the at least one second bore or passage 5.

By way of the single or several bores or passages 6 that are radially provided within the piston rod 1, that are in communication with the second bore passage 5, the disinfecting medium is passed to the inner wall of the cylinder 2.

By way of an appropriate selection of the parameters of volume stream and pressure during egress of the disinfecting medium from the radial bores or passages 6, it is ensured that the disinfecting medium also positively wets the piston rod 1 of the lifting element.

While the egress of the disinfecting medium during the cleaning phase is essentially continuously and concentrated, the egress of the cooling liquid and/or lubricating liquid during the regular course of filling can be continuously, or also be cyclically.

A connection and seal element 8 is disposed at the lower end of the piston rod 1 which element 8 provides a connection between the supply conduit for the compressed air and the disinfecting medium and the bores or passages 4 and 5.

By way of a change-over device, not shown in greater detail but known in the art, the at least one bore or passage 5 can be connected with the supply line of a cooling and/or lubricating liquid for the regular filling process, and for the commencement of a disinfecting process, with the supply conduit of the disinfecting medium.

Figure 1B:
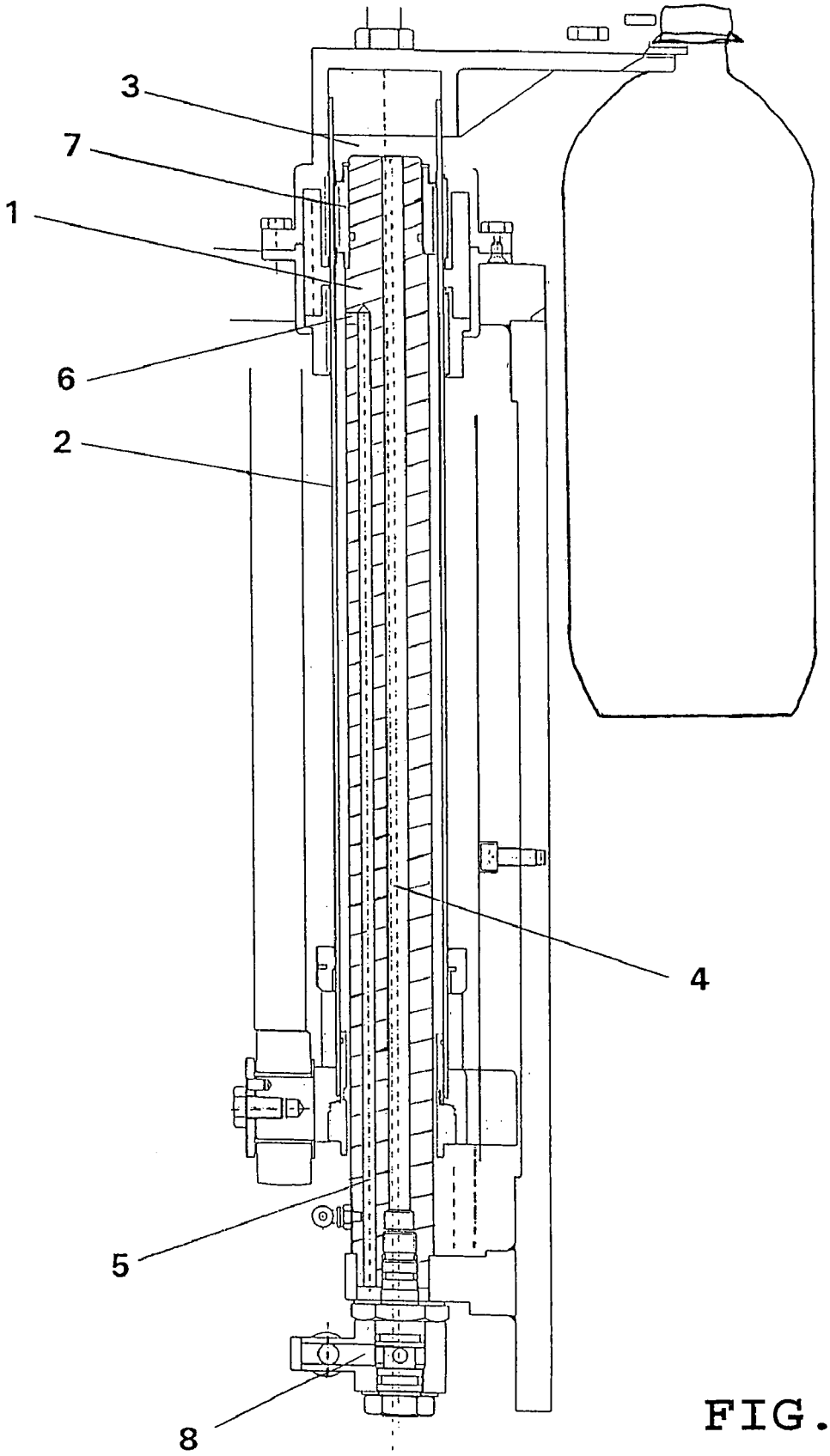
FIG. 1B shows a view similar to that shown in FIG. 1 with additional reference numerals.

FIG. 1B shows a view similar to that shown in FIG. 1 with additional reference numerals.

Figure 2:
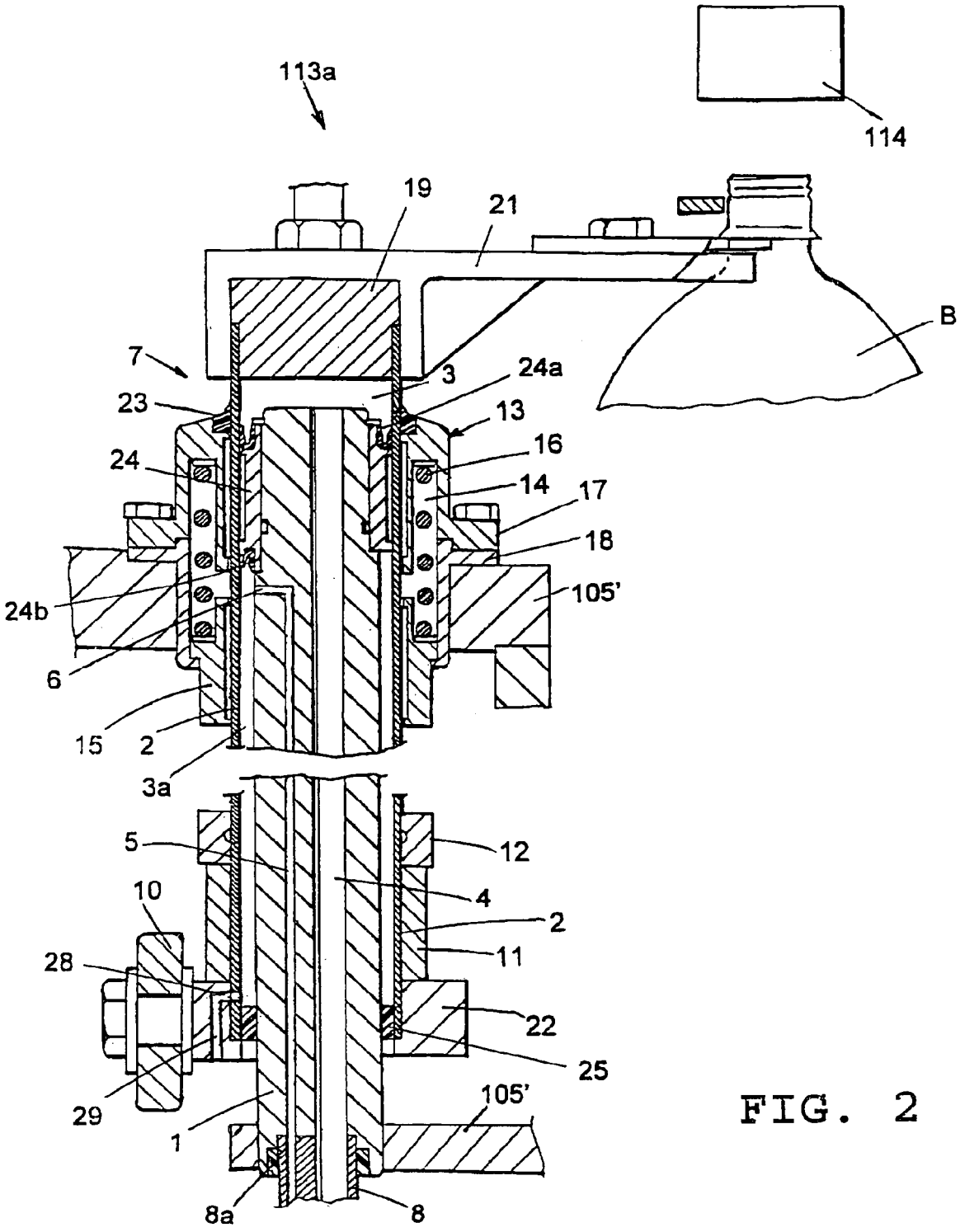
FIG. 2 is a cross-sectional view similar to FIG. 1 of a lifting device in accordance with one embodiment of the application.

With reference to FIG. 2, the rod 1 of lifting device 113*a* is secured to rotor 105'. Rod 1 has a longitudinal passage 4 that has a connection 8 to a supply of compressed air, for example. The roller 10 is secured to the lower end of cylinder 2 and guide formation 22 that guides the cylinder 2 in a matching guide structure, not shown, but being part of rotor 105', upon up-and-down movement of the cylinder 2, is also disposed at the lower end of cylinder 2. The spacer element 11 and collar 12 are disposed near the lower end of the cylinder 2 when the cylinder is disposed in the retracted position. Stop sleeve 15 is part of a stop arrangement that comprises receiving-and-guiding element 13 that forms the housing 14 for spring 16. Thus, receiving-and-guiding element 13 comprises an upper component or stop structure 17 and a lower component or stop structure 18 that together are suitably secured to rotor 105' of the filling machine. The inner cylinder wall is configured and disposed to slide on the rod 1, particularly on the piston member 24 thereof to permit up-and-down movement of the cylinder 2.

Bottle support table or support 21 forms part of the lifting device 113*a* and is secured to the upper end of the cylinder 2 so as to permit raising and lowering of the bottle support 21 and a bottle B supported thereon, when pressure is exerted upon the end-plug 19 that connects the bottle support 21 to the upper end of cylinder 2.

Thus, the upper stop structure 17 is secured to rotor 105' of the filling machine adjacent the upper end of the rod 1 and the cylinder outer wall being configured to slide within the upper stop structure 17, say by intervention of seals 23 and 24*a* and 24*b*. There also possibly being provided a lowermost seal 25. The lower stop structure 15 is operatively connected to the upper stop structure 17 and is configured and disposed to slide on the outer wall of cylinder 2.

Spring 16 is disposed between the upper stop structure 17 and the lower stop structure or stop sleeve 15 and is configured to be compressed between the upper stop structure 17 and the stop sleeve 15.

Upon a pressure medium passing with a first, low, pressure through the longitudinal bore or passage 4 of rod 1 into the cylinder chamber 3, the cylinder 2 is raised providing a chamber portion 3*a* and thus, in turn, raises the bottle support 21 and a bottle B supported thereon to a first position, this being a position in which a bottle B is disposed away from a seal arrangement of a filling device 114, which first position is configured to permit filling of a bottle B with a still beverage, for example, milk. It will be appreciated that the force of the spring 16 and the low pressure preclude further raising of the cylinder 2 since the collar 12 will be in abutment with the stop sleeve 15 and maintains the cylinder 2 and thus the bottle support 21 and a bottle B supported thereon in the first position.

Upon a pressure medium passing with a second, high, pressure through the longitudinal bore or passage 4 of rod 1 into the cylinder chamber 3, the cylinder 2 is raised and thus, in turn, raises the bottle support 21 and a bottle B supported thereon to a second position, this being a position in which a bottle B is sealed to the sealing arrangement of filling device 114, which second position is configured to permit filling of a bottle B with an effervescent beverage, for example, beer.

So as to attain the second position, the spring 16 is compressed by the receiving-and-guiding element 13 and the stop sleeve 15 whereby the stop sleeve 15 has risen further upwardly, due to the force that is generated by the collar 12 bearing on stop sleeve 15.

Figure 3:
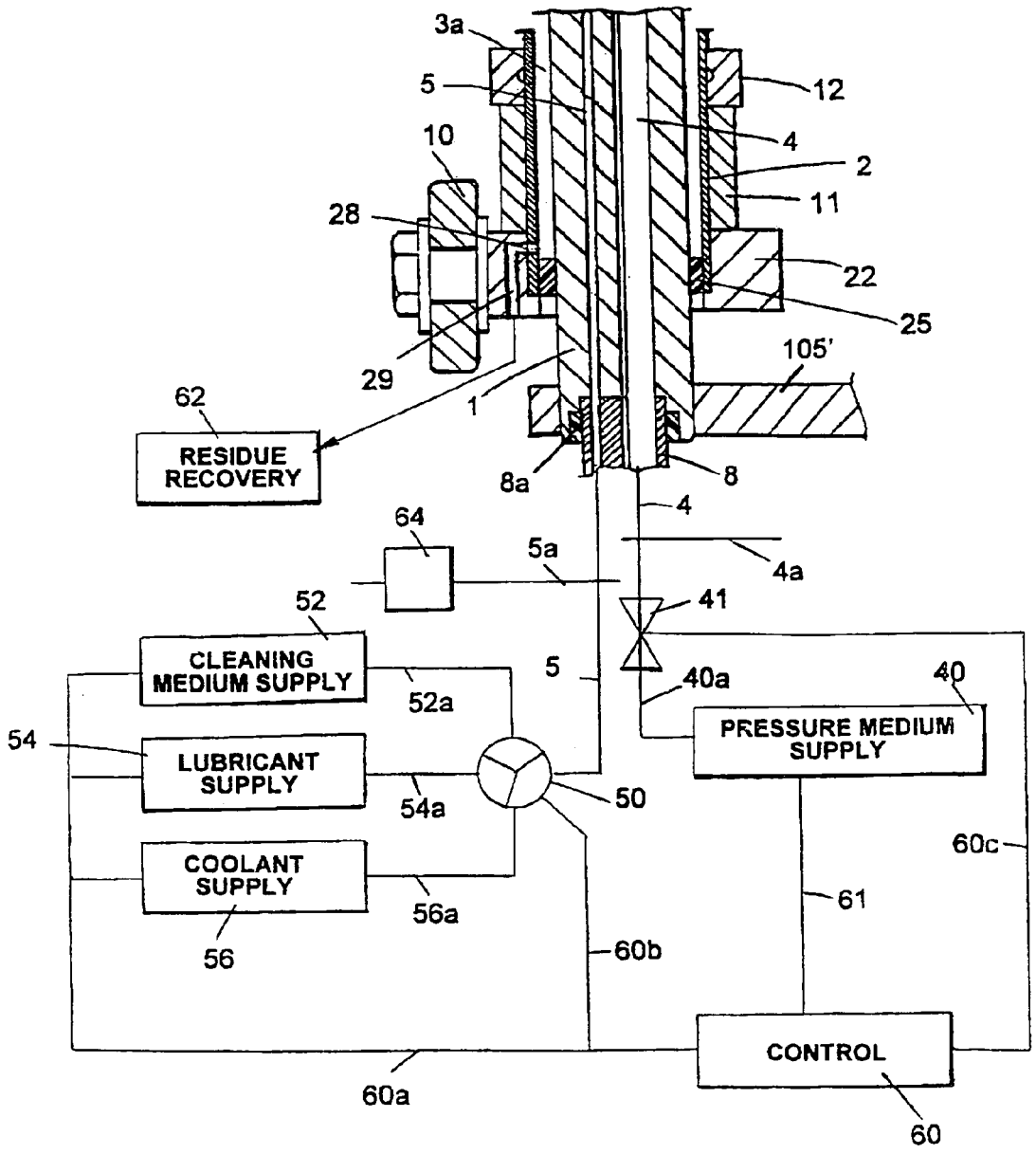
FIG. 3 shows the connection and valving arrangements of a lifting device to supply the lifting device with operating and servicing liquids in accordance with one embodiment of the application.

FIG. 3 illustrates the lower end of the lifting device 113*a* that is shown in FIG. 2.

The lower end of rod 1 has a fitting 8 that is sealed by way of a seal 8*a* in the lower end of rod 1. Fitting 8 accommodates the passage 4 for a pressure medium and the passage 5 for selectively introducing a cleaning medium, or a lubricating medium, or a cooling medium.

The valving arrangement to supply the lifting device 113*a* with a pressure medium comprises a supply of pressure medium 40 that is connected by line or conduit 40*a* to a valve arrangement 41. Valve arrangement 41 may possibly be part of a ring line or annular conduit 4*a* that is configured to connect a plurality of lifting devices 113*a* to one another. It will be appreciated that associated pumps, sensors and other components are included in the valving arrangement configured to supply the pressure medium through the longitudinal passage 4 in the lifting device 113*a*.

The valving arrangement that selectively supplies the lifting device 113*a* through the passage 5 with a cleaning medium, or a cooling medium, or a lubricating medium comprises a valve arrangement 50 to selectively supply a cleaning medium from cleaning medium supply 52 through a line 52*a* to the valve arrangement 50. Similarly, for normal filling operations, a lubricating medium from lubricant supply 54 is provided by way of line or conduit 54*a* to the valve arrangement 50. If cooling of the lifting device 113*a* is desired, the cooling medium is supplied from the coolant supply or cooling medium supply 56 through line or conduit 56*a* to valve arrangement 50 and thence to passage 5. Passage 5 may possibly be connected to a ring line or annular conduit 5*a* that connects the individual lifting devices 113*a* to one another so as to selectively receive the cleaning medium, or the lubricating medium, or the cooling medium.

The operation of the described valving arrangements may possibly comprise a control arrangement 60 to control introduction and release of the pressure medium, control arrangement 60 being schematically connected to the valve arrangement 41 by a line 60*c* and to the pressure medium supply 40 by a line 61, so as to illustrate this control of the introduction and release of the pressure medium. It will be appreciated that sensors and their signals supply the control arrangement 60 which process data, and the control arrangement 60 is configured to issue signals for automatic and controlled operation of the fluid supply for the lifting devices 113*a*. It may also be possible that the control arrangement 60 may possibly be controlled by the central controller 112.

Similarly, the control arrangement 60 is respectively connected by way of line 60*a* to the cleaning medium supply 52, the lubricant supply 54, and the coolant supply 56, and by way of line 60*b* to the valve arrangement 50. Control 60 may possibly also be connected to a distributor 64 that may possibly be part of ring line 5*a*.

Provision is made in a residue recovery 62 for the removal, as required, of excess portions of the cleaning medium or the lubricating medium that my possibly be removed through a bleed port 28 in cylinder 2 and a bleed line 29.

It will be appreciated that supply of the lubricating medium and of the cooling medium to the lifting device is possibly part of the normal filling operation of the filling machine 105. The provision of a cleaning medium to the lifting device 113*a* of the filling machine 105 may possibly be part of a planned cleaning of the filling machine 105.

Such cycles of filling and cleaning of filling machine 105 and the lifting devices 113*a* will depend on a number of factors, such as, type of container that is to be filled, which may comprise bottles, cans, cartons and the like. Other factors include condition of the material that is being filled into containers, for example, hot filling or cold filling, filling of a still beverage, such as, milk, or filling of an effervescent beverage, for example, beer.

One feature or aspect of an embodiment is believed at the time of the filing of this patent application to possibly reside broadly in the lifting device for use at container processing machines in the beverage industry, especially for the utilization at filling machines, characterized in that means are provided which permit a simple and automatic cleaning of the lifting device and/or a liquid-lubricating of the inner wall of the cylinder.

Another feature or aspect of an embodiment is believed at the time of the filing of this patent application to possibly reside broadly in the lifting device characterized in that the means comprise at least one second bore 5, for the introduction of a disinfecting medium and/or lubricating liquid, that is disposed within the piston rod 1.

Yet another feature or aspect of an embodiment is believed at the time of the filing of this patent application to possibly reside broadly in the lifting device characterized in that the at least one second bore 5 is connected by way of at least one further radial bore 6 with the circumferential or outer surface of the piston rod 1.

Still another feature or aspect of an embodiment is believed at the time of the filing of this patent application to possibly reside broadly in the lifting device characterized in that the at least one further bore 6 is disposed, with respect to height, below the seal 7 that is disposed between the piston rod 1 and the cylinder 2.

A further feature or aspect of an embodiment is believed at the time of the filing of this patent application to possibly reside broadly in the lifting device according characterized in that the at least one second bore 5 is supplied by way of an annular conduit with disinfecting medium.

Another feature or aspect of an embodiment is believed at the time of the filing of this patent application to possibly reside broadly in the lifting device characterized in that the at least one second bore 5 is supplied by way of an annular conduit with lubricating liquid and/or cooling liquid.

Yet another feature or aspect of an embodiment is believed at the time of the filing of this patent application to possibly reside broadly in the lifting device characterized in that the annular conduit is connected by means of a rotary distributor to the portion of the container filling machine that does not rotate.

Still another feature or aspect of an embodiment is believed at the time of the filing of this patent application to possibly reside broadly in the lifting device characterized in that the connection of the first bore 4 is to the supply of compressed air and the connection of the second bore 5 is to the supply of the disinfecting medium and/or lubricating liquid, by way of a common connection and seal element 8.

A further feature or aspect of an embodiment is believed at the time of the filing of this patent application to possibly reside broadly in the lifting device characterized in that the parameters for pressure and stream of volume upon egress of the disinfecting medium from the at least one radial bore or passage 6 are selected in such a way that the piston rod 1 is also cleaned.

Some examples of bottling systems that may possibly be utilized or possibly adapted for use in at least one possible embodiment of the present application may possibly be found in the following U.S. Patents, all assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; No. 6,463,964; No. 6,470,922; No. 6,474,368; No. 6,484,477; No. 6,494,238; and No. 6,619,016.

The components disclosed in the various publications, disclosed or incorporated by reference herein, may possibly be used in possible embodiments of the present invention, as well as equivalents thereof.

Some examples of filling machine cleaning methods and apparatus that may possibly be utilized or possibly adapted for use in at least one possible embodiment of the present application may possibly be found in the following patent publications: U.S. Pat. No. 3,964,526 issued to Sindermann on Jun. 22, 1976; U.S. Pat. No. 5,173,259 issued to Bordini on Dec. 22, 1992; U.S. Pat. No. 5,558,138 issued to Stock et al. on Sep. 24, 1996; German Patent No. DE-PS 30 17 197 issued on Jan. 2, 1987; German Laid Open Patent Application No. 39 27 401 published on Feb. 21, 1991; German Laid Open Patent Application No. 41 09 731 published on Oct. 31, 1991; and European Patent No. 0 644 152 published on Mar. 22, 1995.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No.

1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

The appended drawings in their entirety, including all dimensions, proportions and/or shapes in at least one embodiment of the invention, are accurate and are hereby included by reference into this specification.

Some examples of timer apparatus that may possibly be utilized or possibly adapted for use in at least one possible embodiment of the present application may possibly be found in the following U.S. Pat. No. 5,910,739 issued to Stanojevic on Jun. 8, 1999; U.S. Pat. No. 5,999,087 issued to Gunton on Dec. 7, 1999; U.S. Pat. No. 6,016,531 issued to Rixner et al. on Jan. 18, 2000; U.S. Pat. No. 6,020,697 issued to Stenger et al. on Feb. 1, 2000; U.S. Pat. No. 6,020,775 issued to Chevallier on Feb. 1, 2000; and U.S. Pat. No. 6,038,197 issued to Phillips on Mar. 14, 2000.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All, or substantially all, of the components and methods of the various embodiments may be used with at least one embodiment or all of the embodiments, if more than one embodiment is described herein.

Some examples of control valve apparatus that may possibly be utilized or possibly adapted for use in at least one possible embodiment of the present application may possibly be found in the following U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of electric control valves that may possibly be utilized or possibly adapted for use in at least one possible embodiment of the present application may possibly be found in the following U.S. Pat. No. 4,431,160 issued to Burt et al. on Feb. 14, 1984; and U.S. Pat. No. 4,609,176 issued to Powers on Sep. 2, 1986.

All of the patents, patent applications and publications recited herein, and in the Declaration attached hereto, are hereby incorporated by reference as if set forth in their entirety herein.

Some examples of sensors that may possibly be utilized or possibly adapted for use in at least one possible embodiment of the present application may possibly be found in the following U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of pumps that may possibly be utilized or possibly adapted for use in at least one possible embodiment of the present application may possibly be found in the following U.S. Pat. No. 5,653,876 issued to Funke on Aug. 5, 1997; U.S. Pat. No. 5,846,061 issued to Ledebuhr et al. on Dec. 8, 1998; U.S. Pat. No. 6,053,706 issued to Allen on Apr. 25, 2000; U.S. Pat. No. 6,283,727 issued to Borish et al. on Sep. 4, 2001; U.S. Pat. No. 6,517,891 issued to Estelle et al. on Feb. 11, 2003; U.S. Pat. No. 6,568,926 issued to mount on May 27, 2003; and U.S. Pat. No. 6,571,918 issued to Cotler on Jun. 3, 2003.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

An example of a rotary distributor that may possibly be utilized or possibly adapted for use in at least one possible embodiment of the present application may possibly be found in German Utility Model No. 296 20 323 U1 published on Mar. 6, 1997.

The corresponding foreign patent publication application, namely, Federal Republic of Germany Patent Application No. DE P 103 14 634, filed on Apr. 1, 2003, having inventor Herbert BERNHARD, and German Laid Open Patent Application No. DE-OS 103 14 634, having inventor Herbert BERNHARD, and German patent No. DE-PS 103 14 634, having inventor Herbert BERNHARD, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The co-pending U.S. patent application Ser. No. 10/786,256 filed on Feb. 25, 2004, naming Herbert BERNHARD as inventor, having the title "A beverage bottling plant for filling bottles with a liquid beverage filling material, and a container filling lifting device for pressing containers to container filling machines", and the corresponding foreign patent publication applications, namely, Federal Republic of Germany Patent Application No. DE P 103 08 156.9, filed on Feb. 27, 2003, having inventor Herbert BERNHARD, and DE-OS 103 08 156, having inventor Herbert BERNHARD, and DE-PS 103 08 156, having inventor Hebert BERNHARD, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of cylinder lubricating arrangements that may possibly be utilized or possibly adapted for use in at least one possible embodiment of the present application may possibly be found in the following U.S. Pat. No. 4,434,674 issued to Dams on Mar. 6, 1984; U.S. Pat. No. 4,509,468 issued to Cockburn et al. on Apr. 9, 1985; U.S. Pat. No. 4,745,896 issued to Schultz on May 24, 1988; U.S. Pat. No. 5,174,206 issued to Molinatto on Dec. 29, 1992; U.S. Pat. No. 5,465,811 issued to Katz on Nov. 14, 1995; and U.S. Pat. No. 6,681,682.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of pneumatic arrangements that may possibly be utilized or possibly adapted for use in at least one possible embodiment of the present application may possibly be found in the following U.S. Pat. No. 6,609,767 issued to Mortenson et al. on Aug. 26, 2003; U.S. Pat. No. 6,632,072 issued to Lipscomb et al. on Oct. 14, 2003; U.S. Pat. No. 6,637,838 issued to Watanabe on Oct. 28, 2003; U.S. Pat. No. 6,659,693 issued to Perkins et al. on Dec. 9, 2003; U.S. Pat. No. 6,668,848 issued to Ladler et al. on Dec. 30, 2003; and U.S. Pat. No. 6,676,229 issued to Marra et al. on Jan. 13, 2004.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of antiseptic media, disinfectants, coolants, and lubricants that may possibly be utilized or possibly adapted for use in at least one possible embodiment of the present application may possibly be found in HAWLEY'S Condensed Chemical Dictionary, Thirteenth Edition, revised by Richard J. Lewis, Sr., published by John Wiley & Sons, Inc., 1997.

The details in the patents, patent applications and publications may be considered to be incorporable, at applicant's option, into the claims during prosecution as further limitations in the claims to patentably distinguish any amended claims from any applied prior art.

Some examples of cooling arrangements that may possibly be utilized or possibly adapted for use in at least one possible embodiment of the present application may possibly be found in the following U.S. Pat. No. 5,331,884 issued to Ando on Jul. 26, 1994; U.S. Pat. No. 6,553,766 issued to Shimizu et al. on Apr. 29, 2003; U.S. Pat. No. 6,585,095 issued to Savoyard et al. on Jul. 1, 2003; U.S. Pat. No. 6,609,884 issued to Harvey on Aug. 26, 2003; U.S. Pat. No. 6,638,123 issued to Kinomoto on Oct. 28, 2003; and U.S. Pat. No. 6,698,496 issued to Takayama et al. on Mar. 2, 2004.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of hydraulic distributors that may possibly be utilized or possibly adapted for use in at least one possible embodiment of the present application may possibly be found in the following U.S. Pat. No. 4,320,781 issued to Bouvet et al. on Mar. 23, 1982; U.S. Pat. No. 4,549,567 issued to Horton on Oct. 29, 1985; U.S. Pat. No. 4,844,118 issued to Kervagoret on Jul. 4, 1989; U.S. Pat. No. 4,921,072 issued to Divisi on May 1, 1990; and U.S. Pat. No. 5,806,312 issued to Gauss et al. on Sep. 15, 1998.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of seal arrangements that may possibly be utilized or possibly adapted for use in at least one possible embodiment of the present application may possibly be found in the following U.S. Pat. No. 5,411,273 issued to Pietsch et al. on May 2, 1995; U.S. Pat. No. 6,290,234 issued to Berle et al. on Sep. 18, 2001; U.S. Pat. No. 6,474,653 issued to Hintenlang et al. on Nov. 5, 2002; U.S. Pat. No. 6,616,146 issued to Friend et al. on Sep. 9, 2003; U.S. Pat. No. 6,692,007 issued to Oldenburg on Feb. 17, 2004; and U.S. Pat. No. 6,648,335 issued to Ezell on Nov. 18, 2003.

One feature or aspect of an embodiment is believed at the time of the filing of this patent application to possibly reside broadly in a lifting device for use at container processing machines in the beverage industry, especially for the utilization at filling machines, in which are provided means that permit a simple and automatic cleaning of the lifting device and/or a liquid-lubricating of the inner wall of the cylinder.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling bottles with a liquid beverage filling material, said beverage bottling plant comprising:

a filling machine being configured to fill empty bottles with liquid beverage filling material;

a conveyer arrangement being configured and disposed to move empty bottles to said filling machine;

said filling machine comprising a rotor having a peripheral portion;

said filling machine defining a vertical axis about which said rotor is configured to rotate;

said beverage filling machine comprising a plurality of beverage filling positions disposed about said peripheral portion of said rotor;

each beverage filling position comprising a beverage filling device for filling bottles with liquid beverage filling material;

each filling device comprising apparatus being configured to introduce a predetermined volume of liquid beverage filling material into the interior of bottles to a substantially predetermined level of liquid beverage filling material;

said apparatus being configured to introduce a predetermined volume of liquid beverage filling material comprising apparatus being configured to terminate the filling of beverage bottles upon liquid beverage filling material reaching said substantially predetermined level in bottles;

each filling position comprising a support configured and disposed to maintain a bottle in a predetermined position for filling a by a corresponding filling device;

each filling position comprising an arrangement to seal a bottle for filling a bottle with an effervescent beverage;

apparatus being configured to raise and to lower said bottle support and a bottle supported thereby;

said lifting apparatus being configured to raise and lower said bottle support comprising:

a rod having an exterior, a first, lower, end and a second, upper, end remote from said lower end;

said lower end of said rod being secured to said rotor of said filling machine;

a cylinder having a longitudinal axis and having an outer wall and an inner wall disposed about the longitudinal cylinder axis and forming a cylinder interior;

said inner cylinder wall being configured and disposed to slide about said rod to permit up-and-down movement of said cylinder about said rod;

said cylinder having a first, upper, end and a second, lower, end remote from said upper end of said cylinder;

said bottle support being secured to said upper end of said cylinder to permit raising and lowering of said bottle support and a bottle supported thereby;

a collar secured to said lower end of said cylinder;

a first, upper, stop structure secured to said rotor of said filling machine adjacent said upper end of said rod;

said cylinder outer wall being configured to slide within said upper stop structure;

a second, lower, stop structure operatively connected to said upper stop structure and being configured and disposed to slide on said outer cylinder wall;

a spring disposed between said upper stop structure and said lower stop structure and being configured to be compressed between said upper stop structure and said lower stop structure;

said rod comprising at least one first longitudinal passage configured to permit passage of a pressure medium from said lower end of said rod into said cylinder;

said cylinder being configured to be raised by a first, lower, pressure of a pressure medium passing through said first longitudinal passage of said rod and thus raising said bottle support and a bottle supported thereby to a first, lower, position being a position in which a bottle is disposed remote from said seal arrangement which lower position is configured for filling of a bottle with a still beverage;

said cylinder being configured to be raised by a second pressure, being a pressure higher than the first pressure, of a pressure medium passing through said first longitudinal passage of said rod and thus raising said bottle support and a bottle supported thereby to a second, higher, position being a position in which a bottle is sealed to said sealing arrangement which higher position is configured for filling of a bottle with an effervescent beverage;

said collar being configured to be disposed against said lower stop structure to maintain said bottle support and a bottle supported thereby in the lower position upon the lower pressure being applied in said cylinder;

said spring being configured and disposed to be compressed between said upper stop structure and said lower stop structure by said collar upon the higher pressure being applied in said cylinder to permit raising of said bottle support and a bottle supported thereby to the higher position; and a seal arrangement disposed about said rod and being configured to sealingly engage said inner wall of said cylinder;

said rod comprising at least one second longitudinal passage disposed adjacent said first longitudinal passage and being configured to permit passage of at least one of:

a cleaning medium to clean said rod and said inner cylinder wall; and a cooling medium to cool said cylinder and said rod; and a lubricating medium to lubricate said rod and said inner cylinder wall;

said first longitudinal passage comprising an inlet;

said second longitudinal passage comprising an inlet;

a fitting being configured and disposed to connect said inlet of said first longitudinal passage to a source of pressure medium and also to connect said inlet of said second longitudinal passage to a source of at least one of:

a cleaning medium; and a cooling medium; and a lubricating medium;

at least one passage configured to connect said second longitudinal passage to said exterior of said rod and to said interior of said cylinder for the supply of at least one of:

a cleaning medium; and a cooling medium; and a lubricating medium;

into said cylinder;

said filling machine further comprising:

a first valving arrangement being configured and disposed to introduce a pressure medium through said fitting, and through said first longitudinal passage, and into said cylinder;

a second valving arrangement being configured and disposed to introduce at least one of:

a cleaning medium; and a cooling medium; and a lubricating medium;

through said fitting, and through said second longitudinal passage and said connecting passage, and into said cylinder; and a control arrangement being configured and disposed to control introduction of a pressure medium into said cylinder during operating cycles of said filling machine and to control introduction of at least one of:

a cleaning medium; and a cooling medium; and a lubricating medium;

into said cylinder during servicing cycles of said filling machine.

2. The beverage bottling plant according to claim 1, wherein:

said control arrangement is configured to provide automatically control to terminate filling of containers and to initiate cleaning of said filling machine and said lifting device.

3. The beverage bottling plant according to claim 2 comprising all of (a), (b), (c), (d), (e), (f), (g), (h), (i), and (j), wherein (a), (b), (c), (d), (e), (f), (g), (h), (i), and (j) comprise:

(a) said control arrangement comprises a data processor;

said data processor comprises a programmed control apparatus for determining of periods of time of filling of containers and of periods of time of cleaning of said filling machine and said lifting device;

(b) said control arrangement is programmed to control the pressure and the volume of a cleaning medium introduced by said second valving arrangement;

(c) said at least one second longitudinal passage is disposed adjacent said first longitudinal passage; and said second longitudinal passage is configured and disposed to permit introduction into said cylinder of at least one of:

a disinfecting medium; and a lubricating liquid;

(d) said rod comprises a seal arrangement disposed between said rod and said cylinder;

said connecting passage is disposed adjacent said seal arrangement;

(e) said second valving arrangement comprises a conduit configured and disposed to permit passage of a disinfecting medium;

said second longitudinal passage is connected to said conduit for a disinfecting medium;

(f) said second valving arrangement comprises another conduit configured and disposed to permit passage of at least one of:

a lubricating liquid; and a cooling liquid; and said second longitudinal passage is connected to said another conduit to receive at least one of:

a lubricating liquid; and a cooling liquid;

(g) said second valving arrangement comprises a distributor arrangement having at least one rotary part to permit distribution of at least one of:

a disinfecting medium;

a lubricating liquid; and a cooling liquid;

said rotary distributor arrangement is operatively connected to said filling machine at a stationary part of said filling machine;

(h) said first valving arrangement and said second valving arrangement are connected to said first longitudinal passage and said second longitudinal passage by an arrangement that comprises a fitting and a seal;

(i) said first longitudinal passage is configured to permit passage of compressed air into said cylinder to raise said cylinder and a container supported by said cylinder; and (j) said connecting passage is configured to deliver a spray of cleaning medium onto said outer surface of said rod.

4. A method for operating an arrangement for operating and servicing a lifting device of a container filling machine in a plant for filling containers with a liquid beverage, said arrangement comprising:

a first valving arrangement being configured and disposed to introduce a pressure medium into said lifting device and to release a pressure medium from said lifting device to raise and lower said lifting device in said filling machine for filling of containers;

a second valving arrangement being configured and disposed to introduce at least one of:

a cleaning medium; and a lubricating medium;

into said lifting device; and a control arrangement being configured and disposed to control introduction of a pressure medium into said lifting device during filling of containers, and to control introduction of at least one of:

a cleaning medium; and a lubricating medium;

into said lifting device;

said method comprising the steps of:

controlling opening of said first valving arrangement to introduce a pressure medium into said lifting device and to release a pressure medium from said lifting device to raise and lower said lifting device in said filling machine during filling of containers;

introducing a pressure medium into said lifting device to raise said lifting device during filling of containers;

releasing a pressure medium from said lifting device to lower said lifting device during filling of containers;

controlling opening of said second valving arrangement to introduce at least one of:

a cleaning medium; and a lubricating medium;

into said lifting device;

and also controlling at least one of (a) and (b), wherein (a) and (b) comprise:

(a) introducing a cleaning medium into said lifting device to clean said lifting device; and (b) introducing a lubricating medium into said lifting device to lubricate said lifting device.

5. The method according to claim 4, wherein:

said control arrangement is configured to provide automatically control to terminate filling of containers and to initiate cleaning of said filling machine and said lifting device;

and comprising the steps of:

issuing a signal to terminate filling of containers; and issuing a signal to initiate cleaning of said filling machine and said lifting device.

6. The method according to claim 5 comprising all of: (a), (b), (c), (d), (e), (f), (g), (h), (i), (j), (k), and (l), wherein (a), (b), (c), (d), (e), (f), (g), (h), (i), (j), (k), and (l) comprise:

(a) said control arrangement comprises a data processor;

said data processor comprises a programmed control apparatus for determining of periods of time of filling of containers and of periods of time of cleaning of said filling machine and said lifting device;

and comprising the steps of:

determining a period of time of filling of containers; and determining a period of time of cleaning of said filling machine and said lifting device;

(b) said control arrangement is programmed to control the pressure and the volume of a cleaning medium introduced by said second valving arrangement, and comprising the step of:

controlling the pressure and the volume of a cleaning medium introduced by said second valving arrangement;

(c) said lifting device comprises a cylinder having an interior cylinder wall;

said first valving arrangement is configured to introduce a pressure medium into said cylinder during filling of containers; and said second valving arrangement is configured to perform at least one of: (i), (ii), (iii), wherein (i), (ii), and (iii) comprise:

(i) to introduce a cleaning medium to clean said lifting device;

(ii) to introduce a cleaning medium to clean said interior cylinder wall; and (iii) to introduce a lubricating medium to lubricate said interior cylinder wall;

and comprising the steps of:

introducing a pressure medium into said cylinder during filling of containers;

introducing a cleaning medium to clean said lifting device during a period of cleaning;

introducing a cleaning medium to clean said interior cylinder wall during a period of time of cleaning of said filling machine; and introducing a lubricating medium to lubricate said interior cylinder wall during a period of time of filling containers;

(d) said lifting device comprises a rod having a first longitudinal passage for introduction of a pressure medium into said cylinder and having at least one second longitudinal passage disposed adjacent said first longitudinal passage;

said second longitudinal passage is configured and disposed to permit introduction into said cylinder of at least one of:

a disinfecting medium; and a lubricating liquid;

and comprising the steps of:

introducing a pressure medium through said first longitudinal passage into said cylinder; and introducing through said second longitudinal passage into said cylinder of at least one of:

a disinfecting medium; and a lubricating liquid;

(e) said rod comprises a outer surface and a passage configured and disposed to connect said second longitudinal passage with said outer surface of said rod;

and comprising the step of:

introducing through said connecting passage into said cylinder of at least one of:

a disinfecting medium; and a lubricating liquid;

(f) said rod comprises a seal arrangement disposed between said rod and said cylinder;

said connecting passage is disposed adjacent said seal arrangement;

(g) said second valving arrangement comprises a conduit configured and disposed to permit passage of a disinfecting medium;

said second longitudinal passage is connected to said conduit for a disinfecting medium; and comprising the step of:

passing a disinfecting medium through said conduit and through said second longitudinal passage;

(h) said second valving arrangement comprises another conduit configured and disposed to permit passage of at least one of:

a lubricating liquid; and a cooling liquid; and said second longitudinal passage is connected to said another conduit to receive at least one of:

a lubricating liquid; and a cooling liquid;

and comprising the step of:

passing at least one of:

a lubricating liquid; and a cooling liquid;

through said another conduit and through said second longitudinal passage;

(i) said second valving arrangement comprises a distributor arrangement having at least one rotary part to permit distribution of at least one of:

a disinfecting medium;

a lubricating liquid; and a cooling liquid;

said rotary distributor arrangement is operatively connected to said filling machine at a stationary part of said filling machine;

and comprising the step of:

selecting at least one of:

a disinfecting medium;

a lubricating liquid; and a cooling liquid;

for passing through said second longitudinal passage;

(j) said first valving arrangement and said second valving arrangement are connected to said first longitudinal passage and said second longitudinal passage by an arrangement that comprises a fitting and a seal;

(k) said first longitudinal passage is configured to permit passage of compressed air into said cylinder to raise said cylinder and a container supported by said cylinder;

and comprising the step of:

passing compressed air into said cylinder to raise said cylinder and a container supported by said cylinder; and (l) said connecting passage is configured to deliver a spray of cleaning medium onto said outer surface of said rod;

and comprising the step of:

spraying a cleaning medium onto said outer surface of said rod during a period of time of cleaning said filling machine.

7. An arrangement for operating and servicing a lifting device of a container filling machine in a plant for filling containers with a liquid beverage, said arrangement comprising:

a first valving arrangement being configured and disposed to introduce a pressure medium into said lifting device and to release a pressure medium from said lifting device to raise and lower said lifting device in said filling machine for filling of containers;

a second valving arrangement being configured and disposed to introduce at least one of:

a cleaning medium; and a lubricating medium;

into said lifting device; and a control arrangement being configured and disposed to control introduction of a pressure medium into said lifting device during filling of containers, and to control introduction of at least one of:

a cleaning medium; and a lubricating medium;

into said lifting device.

8. The arrangement according to claim 7, wherein:

said control arrangement is configured to provide automatically control to terminate filling of containers and to initiate cleaning of said filling machine and said lifting device.

9. The arrangement according to claim 8, wherein;

said control arrangement comprises a data processor;

said data processor comprises a programmed control apparatus for determining of periods of time of filling of containers and of periods of time of cleaning of said filling machine and said lifting device.

10. The arrangement according to claim 9, wherein;

said control arrangement is programmed to control the pressure and the volume of a cleaning medium introduced by said second valving arrangement.

11. The arrangement according to claim 10, wherein:

said lifting device comprises a cylinder having an interior cylinder wall;

said first valving arrangement is configured to introduce a pressure medium into said cylinder during filling of containers; and said second valving arrangement is configured to perform at least one of: (a), (b), (c), wherein (a), (b), and (c) comprise:

(a) to introduce a cleaning medium to clean said lifting device;

(b) to introduce a cleaning medium to clean said interior cylinder wall; and (c) to introduce a lubricating medium to lubricate said interior cylinder wall.

12. The arrangement according to claim 11, wherein:

said lifting device comprises a rod having a first longitudinal passage for a pressure medium and at least one second longitudinal passage disposed adjacent said first longitudinal passage;

said second longitudinal passage is configured and disposed to permit introduction into said cylinder of at least one of:

a disinfecting medium; and a lubricating liquid.

13. The arrangement according to claim 12, wherein:

said rod comprises an outer surface and a passage configured and disposed to connect said second longitudinal passage with said outer surface of said rod.

14. The arrangement according to claim 13, wherein:

said rod comprises a seal arrangement disposed between said rod and said cylinder;

said connecting passage is disposed adjacent said seal arrangement.

15. The arrangement according to claim 14, wherein:

said second valving arrangement comprises a conduit configured and disposed to permit passage of a disinfecting medium;

said second longitudinal passage is connected to said conduit for a disinfecting medium.

16. The arrangement according to claim 15, wherein:

said second valving arrangement comprises another conduit configured and disposed to permit passage of at least one of:

a lubricating liquid; and a cooling liquid; and said second longitudinal passage is connected to said another conduit to receive at least one of:

a lubricating liquid; and a cooling liquid.

17. The arrangement according to claim 16, wherein:

said second valving arrangement comprises a distributor arrangement having at least one rotary part to permit distribution of at least one of:

a disinfecting medium;

a lubricating liquid; and a cooling liquid;

said rotary distributor arrangement is operatively connected to said filling machine at a stationary part of said filling machine.

18. The arrangement according to claim 17, wherein:

said first valving arrangement and said second valving arrangement are connected to said first longitudinal passage and said second longitudinal passage by an arrangement that comprises a fitting and a seal.

19. The arrangement according to claim 18, wherein:

said first longitudinal passage is configured to permit passage of compressed air into said cylinder to raise said cylinder and a container supported by said cylinder.

20. The arrangement according to claim 19, wherein:

said connecting passage is configured to deliver a spray of cleaning medium onto said outer surface of said rod.

* * * * *